United States Patent [19]

Lynn

[11] Patent Number: 5,012,542

[45] Date of Patent: May 7, 1991

[54] MOPPING SYSTEM

[76] Inventor: William R. Lynn, 38 Prospect St., Dover, N.H. 03820

[21] Appl. No.: 407,445

[22] Filed: Sep. 14, 1989

Related U.S. Application Data

[63] Continuation-in-part of Ser. No. 21,339, Mar. 3, 1987, Pat. No. 4,926,515.

[51] Int. Cl.[5] ..... A47L 13/22; A47L 13/52

[52] U.S. Cl. ..... 15/1; 15/121; 15/244.1; 15/257.1; 15/257.4; 15/257.6; 15/257.9; 15/260; 401/138; 401/196; 401/205

[58] Field of Search ..... 15/257.1–257.4, 15/257.6–257.9, 4, 115, 116.1, 116.2, 119 A, 105, 260, 1; 294/55, 59; 401/196, 205, 140

[56] References Cited

U.S. PATENT DOCUMENTS

| | | | |
|---|---|---|---|
| 389,366 | 9/1888 | Cunningham | 15/257.3 |
| 856,740 | 6/1907 | Snider | 15/257.3 |
| 1,240,241 | 9/1917 | Moss | 15/257.3 X |
| 1,748,336 | 2/1930 | Finnell | 15/257.3 |
| 2,187,671 | 1/1940 | Suddarth | 401/140 |
| 2,823,470 | 2/1958 | Page | 294/55 X |
| 2,935,754 | 5/1960 | Abdo et al. | 15/115 X |
| 2,953,798 | 9/1960 | Borie et al. | 15/99 |
| 3,115,656 | 12/1963 | McKinstry | 15/115 |
| 3,820,905 | 6/1974 | Sims | 401/140 |
| 3,945,078 | 3/1976 | Acquaro | 15/99 |
| 4,119,386 | 10/1978 | Cushing | 401/138 |

FOREIGN PATENT DOCUMENTS

| | | | |
|---|---|---|---|
| 523195 | 10/1953 | Belgium | 15/115 |
| 435142 | 2/1912 | France | 15/257.3 |
| 11413 | 5/1911 | United Kingdom | 294/55 |
| 2168599 | 6/1986 | United Kingdom | 15/257.4 |

*Primary Examiner*—Edward L. Roberts
*Attorney, Agent, or Firm*—Davis, Bujold & Streck

[57] ABSTRACT

A mopping system comprising a scoop pan with a two stage ramp for conveying liquid waste material to an open topped container and a mop support for releasably captively supporting a mop having a mop head, whereby the scoop pan can be manipulated by the mop. The ramp has two serially disposed ramps separated by a gully. The container may lead to a removable storage container or may be arranged to receive and support a liner into which the liquid or waste material passes from the ramp. The mop handle includes storage for liquid to be fed to a foam pad on the mop head.

16 Claims, 2 Drawing Sheets

MOPPING SYSTEM

This applications is a continuation-in-part of U.S. patent application Ser. No. 07/021,339 filed Mar. 3, 1987 Now Pat. No. 4,926,515.

The present invention relates to an improved mopping system allowing for quick and efficient cleaning of a relatively smooth floor surface using a minimal amount of water and detergent so as to leave a relatively dry floor surface, and also allowing for means to pick up bulky objects from a surface along with normal dirt and liquids.

THE PRIOR ART

Mopping systems incorporating the use of water and detergent are well known. A typical mopping system would include a mop with either a loose cloth head ("rag mop") or a sponge head attached to the end of a long metal or wooden pole used in conjunction with a water bucket which may include a squeezing mechanism to assist in squeezing dirty water out of the mop head. Other mops have mechanisms attached directly to the mop head which provide means for squeezing the dirty water out of the rag mop or sponge head of the mop. Other more sophisticated mopping systems, sometimes referred to as cleaning machines, incorporate the use of electric motors to power components such as rotating brushes which are trailed by vacuum suction devices that provide means for picking up dirty water which has been produced by the rotating brushes scrubbing up dirt with the water provided by the machine.

The primary problem with prior art mopping systems and techniques is the inefficient use of water and detergent relative to the amount of floor space cleaned. Also, rag mop systems and mops with sponge heads rinse themselves in their own dirty water. The filth of the water bucket's rinse water is cumulative with each rinse cycle. This results in spreading dirty water around the floor so that the water dries and leaves much of the original dirt on the floor. This effect is compounded unless the water in the bucket is changed frequently.

In addition, prior art mopping systems often leave the cleaned surface in a wet condition of some period of time which is longer than desired. While the cleaned floor surface is wet, there always exists the possibiltiy that someone could slip and fall on the wet surface. This results in additional liability problems relative to cleaning floor surfaces.

Finally, prior art systems are generally inadequate to provide means for cleaning up bulky objects normally seen in the types of spills often found, for example, in a fast food restaurant, e.g., a child spills a soft drink filled with ice, along with a hamburger or a hot dog. These types of spills normally require the restaurant to provide an employee to pick up the ice and hot dog or hamburger bun and meat with paper towels, or some similar technique.

OBJECTS OF THE INVENTION

Accordingly, a primary object of the present invention is to provide a mopping system which substantially reduces the problems noted above.

A more specific object is to provide a mopping system which makes efficient use of water and detergent to clean floor surfaces in a minimal amount of time and which provides the possibility of never recycling dirty water.

Another object of this invention is to provide means for cleaning a floor surface in such a fashion so as to leave a relatively dry surface immediately upon completion of the cleaning process.

A further object of this invention is to provide means for efficiently cleaning up bulky objects along with liquids and normal dirt.

SUMMARY OF THE INVENTION

According to the present invention there is provided a scoop pan for receiving liquid and waste material from a surface being cleaned, comprising a ramp means extending from a ramp edge, for intimately contacting a said surface, to an opening leading to a container for receiving and containing said liquid and waste material.

BRIEF DESCRIPTION OF THE DRAWINGS

For a fuller understanding of the nature and objects of the present invention, reference should be had to the following description given, by way of example, with reference to the accompanying drawings wherein.

DETAILED DESCRIPTION OF THE DRAWINGS

Figure 1:
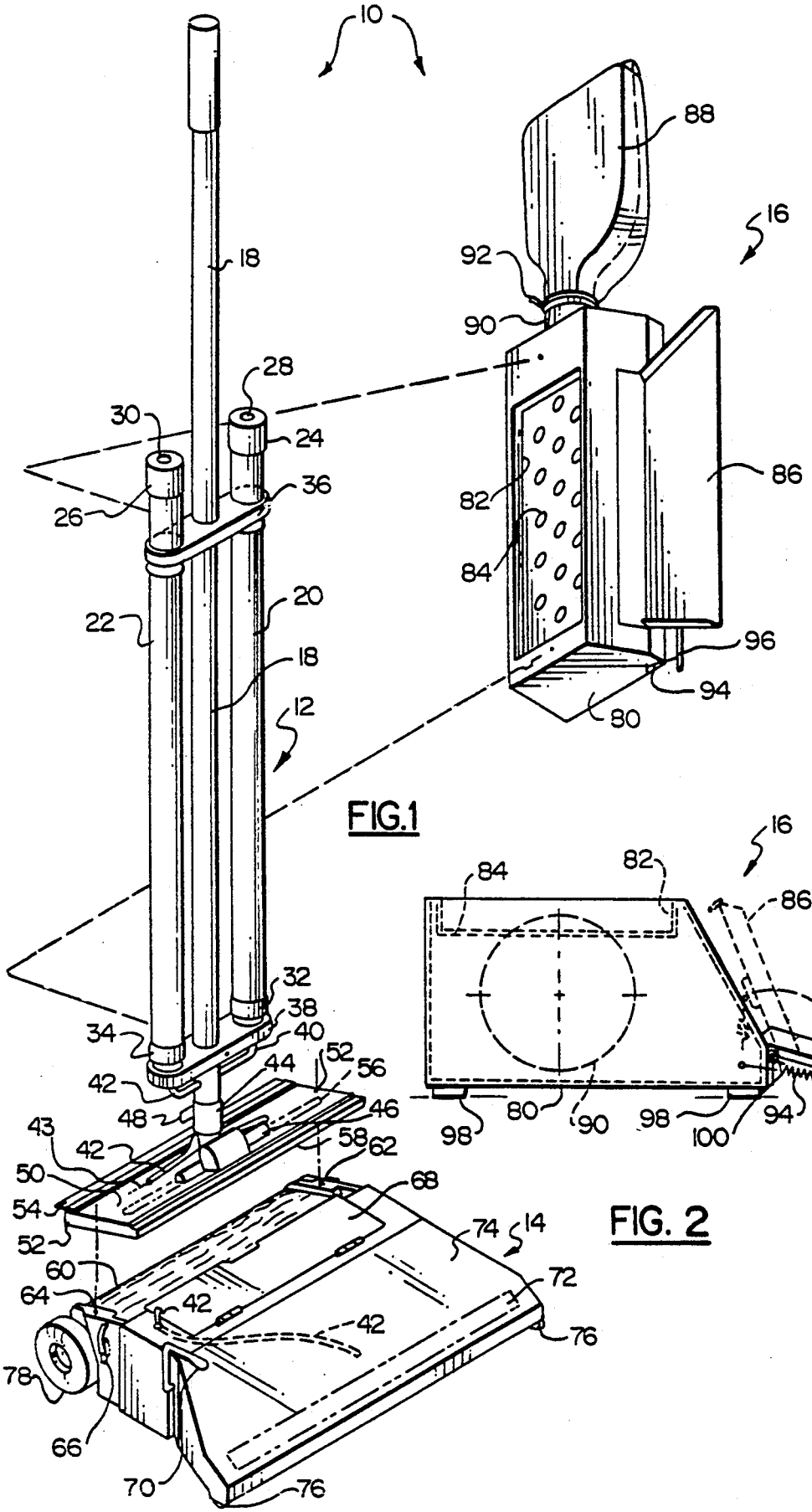
FIG. 1 illustrates first embodiment of a mopping system according to the present invention shown in an exploded view with a cleaning liquid dispensing mop and a scoop pan shown at the right side thereof.

The first embodiment of the present invention is shown in FIG. 1 and comprises a mopping system 10 having a cleaning liquid dispensing mop 12 and a scoop pan 16. The mop 12 has a handle 18, a pad flow tube 20, a direct flow tube 22, a grip 24 on tube 20, a grip 26 on tube 22, a check valve 28 in grip 24, a check valve 30 in grip 26, a pad tube flow valve 32 at the lower end of tube 20, a direct tube flow valve 34 at the lower end of tube 22, an upper mount 36 and a lower mount 38 to support tubes 20 and 22, flow tubing 40 and 42 connected to tubes 20 and 22, respectively, a direct tubing connector 42 for use with a floor cleaner (not shown), a neck 44, a pivot joint 46, a handle lock mechanism 48, a mop head plate 50, openings 52 in plate 50, a squeegee surface 54, a distribution tube 56, and a sponge pad 58.

Mop assembly 12 is controlled with the handle 18. Tubes 20 and 22 contain the desired fluides, e.g., water and detergent, and are attached to handle 18 by means of two mounts 36 and 38 which each has an oval shape and three holes sized to snugly hold handle 18 and tubes 20 and 22. Grips 24 and 26 are attached to the upper ends of tube 20 and 22, respectively, and the check valves 28 and 30 are integrally formed in grips 24 and 26, respectively. Grips 24 and 26 are removable to allow tubes 20 and 22 to be filled through their top ends. The lower ends to tubes 20 and 22 house two flow valves 32 and 34, respectively, which penetrate lower mount 38. The lower end of handdle 18 passes through lower mount 38 and connects to neck 44 which is attached to plate 50 by means of pivot joint 46. Flow tubing 40 and 42 are connected to the discharge side of valves 32 and 34, respectively.

Tubing 40 connects pad flow tube 20 to distribution tube 56, and tubing 42 provides a flow path between tube 22 and the forward portion of a floor cleaner (not shown ) when direct tubing connector 43 is utilized to connect together two mating portions of the tubing 42. Squeegee surface 54 is attached to the rear edge of the plate 50, and sponge pad 58 is attached to the bottom surface of plate 50.

Scoop pan 16 includes a scoop container 80, a recessed area 82 in the top of container 80, openings 84 in recessed area 82, a scoop ramp 86, a collection bag 88, a collection bag neck 90, a bag fastener 92, a ramp spring 94, a ramp lever bar 96, scoop gripping feet 98, and a ramp pivot connection 100.

Figure 2:
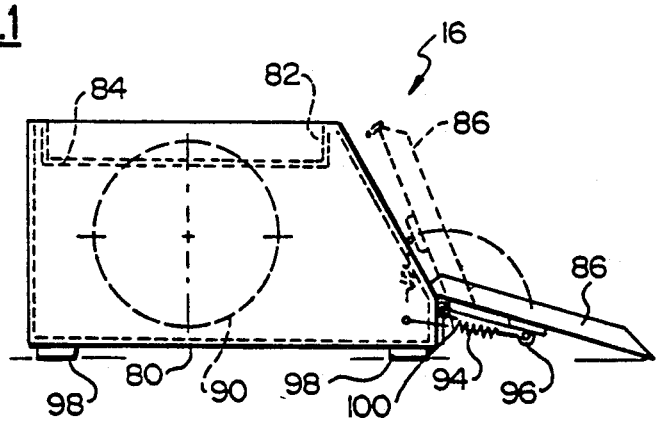
FIG. 2 is a side elevation of the scoop pan shown in FIG. 1.

Turning now to FIG. 2, scoop pan 16 is depicted in side elevation in order to illustrate relative positions of ramp 86, container 80, and collection bag neck 90. The motion of ramp 86 is also illustrated, with solid lines showing the down position of ramp 86 when the user is prepard to scoop material into container 80, and phantom lines depicting the closed position of ramp 86 when it is stored on mop assembly 12 adjacent to tubes 20 and 22. To get from one position to the other, ramp 86 pivots around connection 100 while it also pivots on bar 96 to maintain appropriate separation between ramp 86 and container 80. The recessed area 82 is sized to receive mop head plate 50 so that the sponge pad 58 can be squeezed to release dirty fluids into container 80 through openings 84. Liquids and solids scooped into container 80 via ramp 86 or through openings 84 are transferred into the collection bag 88 by lifting scoop container 80 from the end opposite the collection bag 88 so that the waste material in container 80 pass downward by gravity through neck 90 into bag 88, which is connected to neck 90 with a fastener 92, such as a strip of adhesive tape or a nylon loop which tightens by pulling on one end.

Mopping assembly 12 has a sponge pad 58, which would be attached to the bottom of plate 50, e.g., by the use of Velcro TM , and a squeegee surface 54 on the rear edge of mop plate 50. To clean up an ordinary dirty dry floor surface, the operator would first wet the floor surface via tube 22 and tubing 42 (which in this use is disconnected at connector 43). Liquid is released from pad flow tube 20, by pushing down on grip 24, through flow valve 32 and tubing 40 into distribution tube 56. The liquid then gravity drains from tube 56 onto the top of sponge pad 58 until pad 58 is adequately moistened. Now that the floor is adequately moistened, along with sponge pad 58, assembly 12 can be used to get into the hard-to-reach areas. By unlocking lock mechanism 48, handle 18 can be rotated downward, parallel to plate 50, thus giving it a low profile. Sponge pad 58 can now access vary low areas, e.g. under desks, etc., which often get neglected with conventional mops, and squeegee surface 54 can be used to pull out dirt and large bulky objects where the floor meets the wall, again leaving the floor relatively dry as soon as the cleaning operation is completed.

Still referring to FIGS. 1 and 2, mop assembly 12 may be used by the operator in conjunction which scoop pan 16 when it is necessary to clean up a floor surface with bulky objects, in addition to ordinary dirt and liquids. Scoop pan 16 must first be removed from its stored position at the rear of tubes 20 and 22. The operator then can use mop assembly 12, in the same manner as described above for use of assembly 12 by itself, to clean up any liquids and ordinary dirt. Scoop pan 16 can then be used to help clean up any bulky objects. A common example of when the scoop pan 16 would be required is when someone at a fast food restaurant, who is holding a tray containing a soft drink with ice and a hamberger, spills it. The liquid and ice from the soft drink, along with the hamberger bun and meat patty, could be cleaned up easily using the scoop pan 16 in the same manner. The operator, would place container 80 on the floor next to the liquid, ice and hamburger. Container 80 would be supported by gripping feet 98, which tend to prevent container 80 from slipping around the floor. Scoop ramp 86 would be in its stored position, as shown in phantom in FIG. 2, so the operator would pull ramp 86 downward to the position shown in solid lines in FIG. 2. The operator could then use squeegee surface 54 to scrape the liquid, ice and hamburger from the floor, up ramp 86, and into the interior of container 80. The operator can then use sponge pad 58 again to further clean the floor. Pad 58 can be rinsed by positioning the pad and plate 50 in recessed area 82 and pressing down to release dirty liquid into container 80 via opening 84. The operator then tilts container 80 until collection bag 88 is directly beneath container 80. This would allow gravity to force the liquids, ice, and hamburger to fall through neck 90 into bag 88, or some other collection system. The operator could then loosen fastener 92 and separate bag 88 from neck 90. The open end of bag 88 could then be sealed shut with fastener 92 to allow temporary or permanent disposal of bag 88.

Handle 18 can be pivoted through an arc of approximately ninety degrees about pivot joint 46, from almost parallel to the floor to a vertical position perpendicular to the floor. Handle lock mechanism 48 locks handle 18 in the vertical position when transporting mop assembly 12 and a cleaner (not shown) from the storage site to the floor area to be cleaned.

A possible modification relates to the scoop 16, used in conjunction with mop assembly 12. Wheels could be added to the side of container 80 opposite ramp 86, and fastening clips could be added to the top of container 80 to hold mop assembly 12 to container 80 with plate 50 mated in recessed area 82. This modification would allow mop assembly 12 and scoop 16 to be rolled around and used together as an emergency spill kit as is possible in the second embodiment hereinafter described.

Another alternative configuration of the scoop 16 would be to have the recessed area 82 in the top of container 80 hinged to allow access into the interior of container 80. This modification would allow a more thorough cleaning of the container if it were heavily soiled.

Another possible modification of scoop 16 would be to have collection bag neck 90 configured so as to allow other collection mediums to be used, such as a plastic bottle fastened to neck 90 with a threaded screw-on connection.

Figure 3:
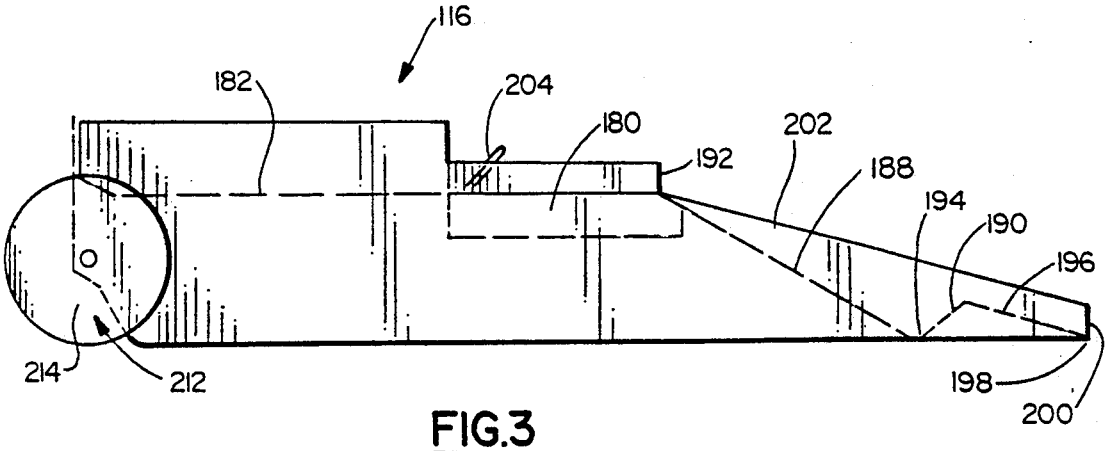
FIG. 3 is a diagrammatic side elevation of a scoop pan forming part of a second embodiment of mopping system according to the present invention.
Figure 4:
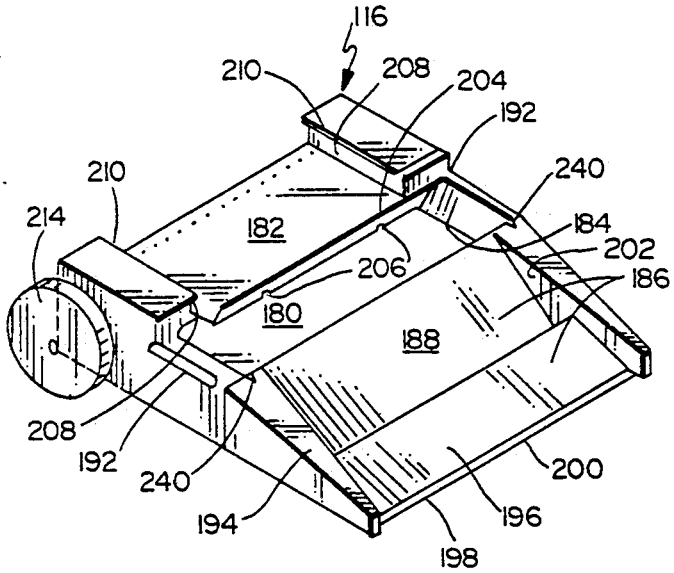
FIG. 4 is a diagrammatic perspective view of the scoop pan shown in FIG. 3.
Figure 5:
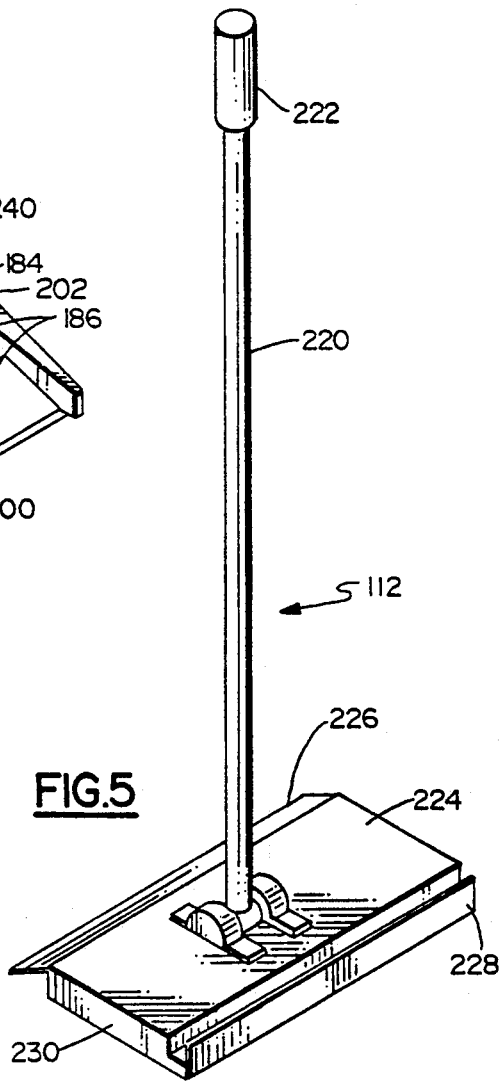
FIG. 5 is a diagrammatic perspective of a cleaning liquid dispensing mop of the second embodiment.

The second embodiment of the present invention as shown in FIGS. 3, 4 and 5 comprises a mopping system having a cleaning liquid dispensing mop 112 and a scoop pan 116.

The scoop pan 116 includes a scoop container 180, a recessed area 182 in the top of the container 180, and a scoop ramp 186. Container 180 has an upwardly facing opening 184 extending across its width between supports 192 for supporting a container liner (not shown) in the container 180 with a liner opening underlying the opening 184 so that liquid and other waste material disposed on the ramp 186 may be caused to fall through the opening 184 into the liner in the container 180. The opening 184 is substantially rectangular with one edge of the rectangle defining the inner extent of the ramp 186. The ramp 186 is a two-stage ramp having a first ramp portion 188 extending downwardly from the opening 184 to a revetment 190 which together with the ramp surface 188 defines a gully 194 extending across the width of the ramp 186. The revetment 190 leads to a second ramp surface 196, of the ramp 186, extending downwardly to the outward extension 198 of that ramp which terminates in a squeegee 200 disposed for intimate contact with a surface to be cleaned by the mopping system.

The tranverse extent of the ramp 186 is terminated at each side by a wall 202 which prevents liquid and waste material from leaving the ramp in a transverse direction.

At the corners of the rectangular opening 184, adjacent the ramp 186, there are provided slots 240 which permit a liner when supported on the liner supports 192 to extend under the inner end of the ramp surface 188 so that liquid and waste material from ramp surface may fall into the liner even when the scoop pan 116 is flat on the surface being cleaned.

The recessed area 182 is terminated adjacent the opening 184 by an upstanding ridge 204 extending at an angle over the edge of the opening 184 opposite the edge defined by the ramp 186. This ridge defines an edge, disposed over a liner in the container 180, against which a sponge pad on mop 112 may be pressed to squeeze liquid from that pad to fall into the liner. Openings 206 are provided at the base of the ridge 204 to allow liquid which falls on the wrong side of that ridge to pass through the ridge into the container 180. The recessed area 182 is a flat rectangle which terminates at an edge opposite the ridge 204 with a slight rise which serves to prevent liquid present on the area 182 from running rearwardly off of the scoop pan instead of through the openings 206. The recessed area 182 is sized to receive the mop head including the sponge pad of a mop 112 and is provided with side walls 208 having flanges 210 overhanging the recessed area 182 to hold captive the head of an appropriately sized mop 112 whereby when such a mop 112 is engaged with the scoop pan 116, the scoop pan can be moved over the surface to be cleaned, carried or tilted by the mop 112. On either side of the scoop pan 116, adjacent the rear most extension 212, are co-axial wheels 214 disposed one on either side of the scoop pan 116 to support the rear of that pan over the surface being cleaned, while the squeegee 200 remains in contact with that surface, and spaced rearwardly enough to permit the pan to be tilted about the axis of the wheels sufficiently for liquid and waste in the gully 194 to be conveyed by gravity up the ramp 188 and into the liner in the container 180, or into the container itself in the absence of such a liner.

Now with reference to FIG. 5, the mop 112 comprises a hollow, elongate handle 220 terminating at one end in the hand grip 222 and at the other end in a pivotal connection to a mop head 224. As with the first embodiment, the mop head carries at one edge a squeegee 226. The squeegee 226 defines the rear edge of the mop head while at the opposite or front edge of the mop head is an accessory mounting flange and groove 228 suitable for the attachment of scrubbing tools, cleaning devices or scraper edges which might be used with the system of the present invention. To the underside of the mop head 224 is attached a sponge pad 230 in a similar manner to the arrangement of the first embodiment. Cleaning liquid may be housed in the hollow handle 220 with arrangements for its dispensation to the sponge pad in much the same manner as cleaning liquid is dispensed to the sponge pad in the first embodiment as described above. This mechanism is not described in detail here as this mechanism does not form a part of the invention if this continuation-in-part application and, would, in any event be apparent to those skilled in the art having read the first embodiment and being familiar with the prior art.

The mop head 224 is sized to fit within the area 182 of the scoop pan 116 and the be held captive thereon by the flanges 210 and ridge 204 with the assistance of the raised area at the rear of the area 182. When so engaged, the mop 112 can be used to move the scoop pan 116 over a surface with the assistance of the wheels 214, to facilitate carriage of the scoop pan utilizing the handle of the mop and to facilitate the tilting of the scoop pan 116 about the rotational axis of the wheels 214 as previously described. When removed from its captive engagement with the scoop pan 116, the mop 112 can be used in a similar manner to that described with reference to the first embodiment of the present invention with the squeegee 226 being useful for conveying liquid and waste material from the surface being cleaned over the surface contacting edge 198 of the ramp 186 up the ramp surface 196 into the gully 194 and if desired also up the ramp surface 188 directly into a liner in the container 180.

We claim:

1. A scoop pan for receiving liquid and waste material from a surface being cleaned, comprising:

a ramp means extending from a ramp edge, for intimately contacting a said surface, to an opening leading to a container for receiving and containing said liquid and waste material, a mop contact area with means for captively engaging a cooperating mop head, said area being disposed on a side of said opening of the said container remote from said ramp means, wherein said area is terminated adjacent said opening by a ridge extending transversely of said scoop pan and disposed for engagement by a mop head to squeeze liquid therefrom into said container.

2. A scoop pan according to claim 1 wherein sides of the ramp means terminate at upstanding walls which prevent said liquid and waste material from leaving the ramp means over said sides.

3. A scoop pan according to claim 2 comprising a liquid and waste material storage bag supporting means cooperating with said container to support bag means to receive said liquid and waste material when desired.

4. A scoop pan according to claim 1 wherein said ridge has at least one opening allowing passage from said area to said opening.

5. A scoop pan according to claim 1 wherein said ridge overlies at portion of said opening.

6. A scoop pan according to claim 1 in combination with a mop comprising a handle mounted to a mop head, including a foam pad, sized and shaped to releasably captively engage said scoop pan in said mop contact area.

7. A combination according to claim 6 wherein said handle includes a liquid store to dispense liquid to said foam pad.

8. A scoop pan for receiving liquid and waste material from a surface being cleaned, comprising a ramp means extending from a ramp edge, for intimately contacting a said surface, to an opening of a container for receiving and containing said liquid and waste material, said ramp means defining serially disposed first and second ramps with said first ramp extending from said edge to a gully between said first ramp and said second ramp, said second ramp extending upwardly to said opening whereby said liquid and waste material passing from said edge up said first ramp may be retained in said gully for subsequent conveyance up said second ramp to said opening, wherein does of sides ramp means are terminated by means preventing passage of said liquid and waste material over said sides when on said ramp means and said opening is associated with liner supports adapted to support an open top liner in said container to receive said liquid and waste material passing through said opening.

9. A scoop pan according to claim 8 wherein sides of the ramp means terminate at upstanding walls which prevent said liquid and waste material from leaving the ramp means over said sides.

10. A scoop pan according to claim 8 wherein said liner supports are adapted to support a said liner so that part of its open top underlies, in part, said second ramp.

11. A scoop pan for receiving liquid and waste material from a surface being cleaned, comprising a ramp means extending through a ramp edge, for intimately contacting a said surface, to an opening of a container for receiving and containing said liquid and waste material, said ramp means defining serially disposed first and second ramps with said first ramp extending from said edge to a gully between said first ramp and said second ramp, said second ramp extending upwardly to said opening whereby said liquid and waste material passing from said edge up said first ramp may be retained in said gully for subsequent conveyance up said second ramp to said opening, and a mop contact area with means for captively engaging a cooperating mop head, said area being disposed on a side of said opening remote from said ramp means.

12. A scoop pan according to claim 11 wherein said area is terminated adjacent said opening by a ridge extending transversely of said scoop pan and disposed for engagement by a mop head to wring liquid therefrom into a said liner, when in said container and mounted on said supports.

13. A scoop pan according to claim 12 wherein said ridge has at least one opening at its base allowing passage of liquid from said area to said opening.

14. A scoop pan according to claim 12 wherein said ridge overlies a portion of said opening with said open top of said liner, when present, underlying said ridge to receive liquid therefrom.

15. A scoop pan according to claim 11 in combination with a mop comprising a handle mounted to a mop head, including a foam pad, sized and shaped to releasably captively engage said scoop pan in said mop contact area.

16. A combination according to claim 15 wherein said handle includes a liquid store to dispense liquid to said foam pad.

* * * * *

UNITED STATES PATENT AND TRADEMARK OFFICE

CERTIFICATE OF CORRECTION

PATENT NO. : 5,012,542

DATED : May 7, 1991

INVENTOR(S) : William Randall LYNN

It is certified that error appears in the above-identified patent and that said Letters Patent is hereby corrected as shown below:

Column 7, line 13 delete "does of";
line 13 after "sides" insert --of said--;
line 29 delete "through" and insert --from--.

Signed and Sealed this

Sixth Day of October, 1992

*Attest:*

DOUGLAS B. COMER

*Attesting Officer*

*Acting Commissioner of Patents and Trademarks*